United States Patent [19]

Manns

[11] 4,135,281

[45] Jan. 23, 1979

[54] METAL-DIELECTRIC ELECTRON BEAM SCANNING STACK

[75] Inventor: William G. Manns, Dallas, Tex.

[73] Assignee: Texas Instruments Incorporated, Dallas, Tex.

[21] Appl. No.: 746,909

[22] Filed: Dec. 2, 1976

[51] Int. Cl.[2] ..... H01J 9/02

[52] U.S. Cl. ..... 29/25.14; 29/25.13

[58] Field of Search ..... 29/25.16, 25.14, 25.13, 29/592 E; 156/309

[56] References Cited

U.S. PATENT DOCUMENTS

| | | | |
|---|---|---|---|
| 2,646,521 | 7/1953 | Rajchman | 313/470 X |
| 3,458,745 | 7/1969 | Shoulders | 313/348 X |
| 3,680,184 | 8/1972 | Greene | 29/25.14 |
| 3,922,577 | 11/1975 | Orthuber | 313/495 X |
| 3,936,697 | 2/1976 | Scott | 313/495 X |

FOREIGN PATENT DOCUMENTS

| | | | |
|---|---|---|---|
| 1051427 | 2/1959 | Fed. Rep. of Germany | 313/94 |

*Primary Examiner*—Richard B. Lazarus

*Attorney, Agent, or Firm*—James T. Comfort; Rene' E. Grossman; William E. Hiller

[57] ABSTRACT

A metal-dielectric electron beam scanning stack and method for making the same is disclosed. The electron beam scanning stack subassembly is fabricated from at least a pair of metal plates, each having a plurality of apertures defined therein. Individual apertures are aligned with corresponding apertures of the other plate to form a plurality of electron beam channels. These plates are electrically isolated from and bonded to each other by a layer of dielectric material without the use of a spacer plate. By etching isolation channels in each of these plates in a selected pattern, control plates are fabricated having a plurality of isolated conductive portions arranged in selected patterns. These subassemblies are bonded together using either dielectric material or dielectrically coated metal spacer plates having a plurality of corresponding aligned apertures. Contact leads from the plurality of isolated conductive portions are isolation etched into the inactive peripheral area of the plate. These leads extend along the periphery of the plate where they terminate in the form of multiple contact means protruding from the edge of the plate.

7 Claims, 8 Drawing Figures

Fig. 1
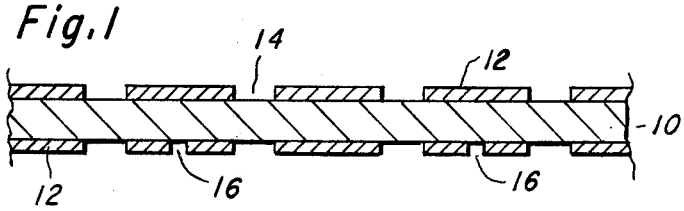
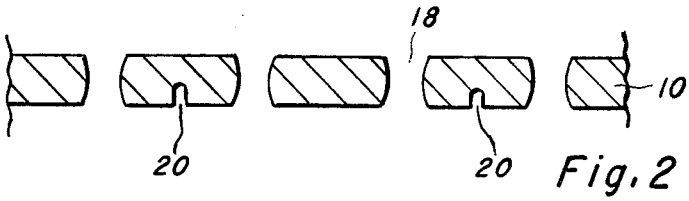
Fig. 2
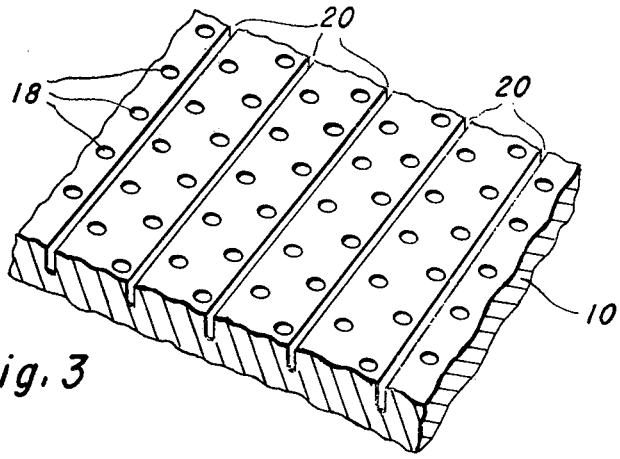
Fig. 3
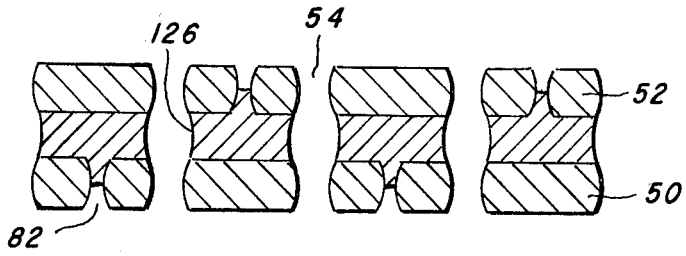
Fig. 4

METAL-DIELECTRIC ELECTRON BEAM SCANNING STACK

BACKGROUND OF THE INVENTION

The present invention relates in general to an electron beam scanning device and more particularly to a metal-dielectric electron beam scanning stack and method for making the same.

This application is filed on even date with another copending patent application by William Gary Manns and also assigned to Texas Instruments Incorporated, the same assignee of the present patent application. Both of these inventions relate to the fabrication of a metal-dielectric electron beam scanning device. The invention of the present application eliminates the need for using spacer plates in the manufacture of the subassemblies, thus reducing the number of plates per flat tube display and a reduction in its associated manufacturing cost.

Present flat tube displays are fabricated from glass switching plates and glass spacer plates. Each plate is provided with a matrix of apertures therein fabricated by a chemical etching technique. In fabricating a matrix of apertures in the glass plates, etching masks of precious metals, for example, platinum, gold and titanium are employed to protect selected planar surfaces of the glass plates from the etchant solutions. Upon completion of the etch process, these precious metals are stripped and recovered by standard refining techniques.

The switching plates are coated on both sides and through the aperture holes with a metallized thin-film employing standard techniques. This metallized thin-film is patterned into an appropriate switching matrix using either a conventional photolithographic metal-etching technique or standard photoresist lift-off techniques.

Gold ribbon leads are reflow solder bonded to metallized bonding pads located on each of the switching plates corresponding to each switching matrix pattern. The glass spacer plates are coated with solder glass-frit and the plates assembled into a switching stack array using a thermal solder glass-frit firing cycle and aperture alignment fixtures. These switching stacks thereby comprise alternate layers of glass switching plates and glass insulating plates. The matrix array of aligned apertures in the glass plates provides electron beam channels to the phosphor coated screen. The gold leads are bonded to a mounting plate during the assembly providing for the external electronic circuit connections.

These glass stacks are mechanically fragile, expensive to fabricate, and are frequently broken by thermal stresses during fabrication and operation. In addition, dangerous chemical etching systems used for the glass etching require very expensive processing equipment for adequate operating safety. As noted above, the glass etching process requires expensive precious metal masking in addition to the standard photoresist masking. The low thermal conductivity of the glass switching plates and spacers results in excessive stack heating during high stack input currents that are required for high brightness displays. Finally, thin-film metal deposition processes require vacuum metal applications that increase costs due to the use of multiple vacuum process steps. Other nonvacuum deposition processes have not been successfully demonstrated for switching stack fabrication.

SUMMARY OF THE INVENTION

A metal-dielectric electron beam scanning stack and method for making the same is described. The electron beam scanning stack subassembly is fabricated from at least a pair of metal plates each having a plurality of apertures defined therein. Individual apertures are aligned with corresponding apertures of the other plate to form a plurality of electron beam channels therein. These plates are electrically isolated from and bonded to each other by a layer of dielectric material without the use of a spacer plate. By etching isolation channels in each of these plates in a selected pattern, control plates are fabricated having a plurality of isolated conductor portions arranged in preselected patterns. Subassemblies are bonded together using dielectric material or dielectrically coated metal spacer plates having a plurality of correspondingly aligned apertures. Contact leads from the plurality of isolated conductor portions are isolation etched into the inactive peripheral area of the plate. These leads extend along the periphery of the plate where they terminate in the form of multiple contact tabs protruding from the edge of the plate.

The metal-frit laminated stack is made from inexpensive materials using high yield processes. Relatively small losses occur due to breakage during stack fabrication. Because of the improved thermal conductivity as compared to the glass plates of the prior art, the stack can be operated at much higher input current levels without stack distortion or destruction. Metal leads can be fabricated as an integral part of the switching stack. This eliminates anywhere from 100 to more than 500 wire bonds per tube depending on the tube resolution. This method is well suited to high resolution products as well as low resolution displays.

Accordingly, an object of the present invention is to provide a method for the fabrication of a metal-dielectric electron beam scanning stack.

Yet another object of the present invention is to provide an electron beam switching device that can operate at much higher current input to the input buffer without danger of stack breakage.

Another object of the present invention is to provide an electron beam scanning device having improved operating characteristics.

Still another object of the present invention is to provide a simpler and more economical fabrication technique for the fabrication of electron beam switching devices.

BRIEF DESCRIPTION OF THE DRAWINGS

The invention, together with its various features and advantages, can be easily understood from the following, more detailed description taken in conjunction with the accompanying drawings in which:

FIGS. 1 and 2 are sectional views of a portion of a metal plate showing progressive steps in the fabrication of a metal switching plate according to the process of the invention.

FIG. 3 is a top view of a switching plate showing partial isolation grooves and finger patterns fabricated according to the present invention.

FIG. 4 is a sectional view of a subassembly used in the fabrication of an electron beam scanning device according to the process of the invention.

DETAILED DESCRIPTION

Figure 5:
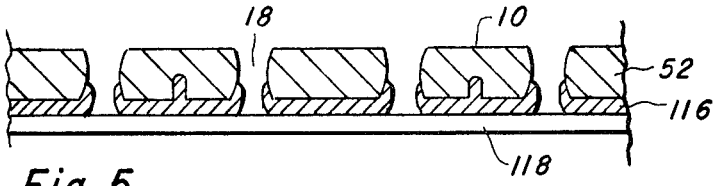
FIG. 5 is a sectional view indicating the "etch-back" process.

Prior to the fabrication of the electron beam scanning stack by the method of the present invention, the metal sheets are chemically cleaned and dimensionally stabilized. In cleaning the metal sheets, any conventional technique may be utilized. In one method the metal sheets are first degreased by a suitable solvent such as trichloroethylene. The degreased sheets are rinsed in a water spray prior to being etch cleaned in a diluted ferric chloride solution, 39° baume. It is evident to one skilled in the art that other etching compositions may be utilized with the method of the present invention. The precleaned metal sheets are dimensionally stabilized by firing the plates at 975° C for 15 minutes in a dry hydrogen atmosphere. The hydrogen atmosphere prevents the formation of any surface oxides in addition to reducing any surface oxides already formed thereon. Other reducing atmospheres and firing temperatures may be employed for this dimensional stabilization process.

Referring now to FIGS. 1–3, the method for fabricating metal plates having a preselected matrix of apertures therein and patterned isolation grooves is indicated according to the methods of the present invention. A previously cleaned and dimensionally stabilized metal plate 10 is employed. The composition of this metal plate may comprise a variety of alloys. Particular properties of the metal plate are that it has a high electrical and thermal conductivity and a thermal coefficient of expansion compatible with the use of the dielectric material used as a sealant and electrical isolation medium. Useful metal alloys may comprise: 42% or 46% nickel with the balance iron, 1008 steel, and Sealmet 1 (28% chrome, balance iron). The present embodiment employs an alloy comprising 46% nickel with the balance iron. It is apparent to one skilled in the art that other metal alloys may be used according to the method of the present invention.

The top and bottom planar surfaces of the metal plate are coated with a layer of photoresist 12, for example, AZ1350J. By using standard photolithographic techniques, the photoresist layers 12 are patterned so as to have mask apertures 14 defining the selected aperture matrix pattern of the completed metal plates. The corresponding apertures 18 are etched through the metal plate 10 by means of a suitable etchant composition. One particular etching composition used under the method of the present invention comprised a mixture of 46° baume ferric chloride and hydrochloric acid. Other etchant compositions or other techniques for producing the aperture holes within the metal plate may be used without departing from the scope of the present invention.

As noted in FIG. 3, the metal plate 10 has a matrix of apertures 18 defined therein in a preselected pattern comprising a hexagonal array. Other preselected matrix patterns may be employed with equal utility. The thickness of the metal plates employed by the method of the present invention is approximately 2 mils. Other thicknesses in the range of about 1–20 mils for the metal plate as well as other plates of the electron beam scanning device in the present embodiment may be used without departing from the scope of the present invention.

The metal plate 10 may be utilized for a variety of functions, for example, a buffer plate, a focusing plate, a modulating plate, or a switching plate. In this respect, the metal plate is separated into a plurality of separate conductor portions arranged in selected patterns. In one embodiment the bottom layer of photoresist 12 is patterned so as to define isolation channels 16 of the corresponding conductive pattern. The etched groove pattern 20 is fabricated during the same etching operation that defines the matrix of hole apertures 18 in the same metal plate as indicated by FIGS. 2 and 3. As indicated in FIGS. 2 and 3, this sequence of etching and making operations provides a metal plate 10 having a matrix of apertures 18 defined therein partially separated into separately isolated conductive portions by an etched groove 20.

The isolated conductive portions can be fabricated into a variety of geometric patterns that will have utility within an electron beam switching stack. Accordingly, such isolated conductive portions may be patterned in the form of fingers, interdigitated fingers, serpentines, strips, bars, graphic shapes, dynodes, and trinodes. Other selected patterns of the type described will also have utility with the method of the present invention.

In another embodiment (not shown) the separately isolated conductive portions may be fabricated after completion of the subassembly. In this regard, etching the isolation grooves is achieved in a one-step process from one side of the metal plate only.

FIG. 4 indicates one subassembly embodiment of the present invention comprising two metal plates 50 and 52. Both metal plates have a plurality of apertures 54 defined therein, fabricated according to the method already described. In addition, both metal plates have fabricated therein isolation grooves 82, so as to provide a plurality of isolated conductive portions. These two plates are bonded together using dielectric material, so as to align their corresponding apertures and to provide a matrix of electron beam channels therein. The subassembly fabricated in this manner may comprise more than two plates. For example, the subassembly may comprise three plates or any other number of plates by successively bonding one plate on top of another using dielectric material and aligning their corresponding apertures and successively etching the isolation grooves prior to bonding the next successive plate.

One type of dielectric material used in the present embodiment is vitreous glass-frit. However, the method of the present invention may be practiced by using other types of dielectric material, for example, porcelain enamels, solder glass-frits, ceramic pastes, and crushed mica.

In bonding the two plates together to provide a subassembly, the plates are coated with vitreous glass-frit over the planar surface area so as to provide electrical insulation and bonding material 126 with the neighboring bonded metal plate. In one embodiment the metal plates 50 annd 52 are bonded by coating one surface of each plate with a layer of vitreous glass-frit. The total combined thickness of the vitreous glass-frit layer 126 results in an electrical isolation layer of approximately 2 mils having a useful range of about 1–10 mils. As indicated in FIG. 4, the vitreous glass-frit layer fills into the isolation groove 82 of the isolated conductive pattern. In an alternative embodiment, a heavier deposit of vitreous glass-frit may be applied to single plate 50 or 52 to eliminate the double process step of applying a vitreous glass-frit layer to each of the neighboring metal plates.

One aspect of the fabrication process of the present invention is that there be a clear, free electron path through the metal plate assembly. During the application of vitreous glass-frit to the planar surface area of the spacer plates, it is highly likely that glass-frit will penetrate into the aperture opening in a manner so as to reduce their effective diameter. If glass-frit should obstruct the holes, incoming electrons will subsequently hit the glass-frit coating and deposit a negative charge thereon. As this charge builds up, it will effectively shut off that hole by repelling any incoming electrons. A method for eliminating this problem is to employ a suitable hole cleaning method, such as an "etch-back" process, in order to remove any glass-frit within the apertures or, in the alternative, to develop a glass-frit application method which will not deposit the dielectric material within the apertures.

The "etch-back" process as indicated in FIG. 5 is one method of eliminating this problem. The dielectric material 116, upon application to the planar surface of the metal plate 52, partially extends into the apertures 18. To selectively remove this material, a mask layer 118 is deposited over the entire planar surface of the metal plate so as to block off the apertures therein. This mask material does not have to be photosensitive, only that it be chemically inert to the etching chemical being used. In one embodiment a mixture of hydrofluoric acid and hydrochloric acid is used. The metal plate is dipped in the etching solution for a sufficient duration, so as to "etch-back" the glass-frit resulting in an unobstructed aperture as indicated in plates 50 and 52 of FIG. 4. In the alternative, the assembled subassembly as indicated in FIG. 4 may be dipped in the etching solution to etch the apertures free of any glass-frit and produce the "etch-back" profile.

In the embodiment wherein the isolation grooves are partially etched into the metal plate, it is necessary to complete the isolation step by etching through the metal plate completely from the opposite side. FIG. 4 represents the final profile of the completed subassembly. After the subassembly plates are laminated together, both of the outside plates are patterned using a dry-film photoresist layer. The photoresist layer is patterned so as to expose the isolation channels 82 corresponding to the already partially etched isolation grooves. In the manner described above, the isolation grooves are etched through the plates, so as to define the completed isolation grooves 82 as indicated in FIG. 4. The photoresist employed blocks the electron beam holes 54 in the substrate, thus preventing etchant contamination of the vitreous glass-frit in areas that will be exposed to an electron beam. This minimizes out-gassing and cathode poisoning. It also eliminates further etching of the hole diameter.

Figure 6:
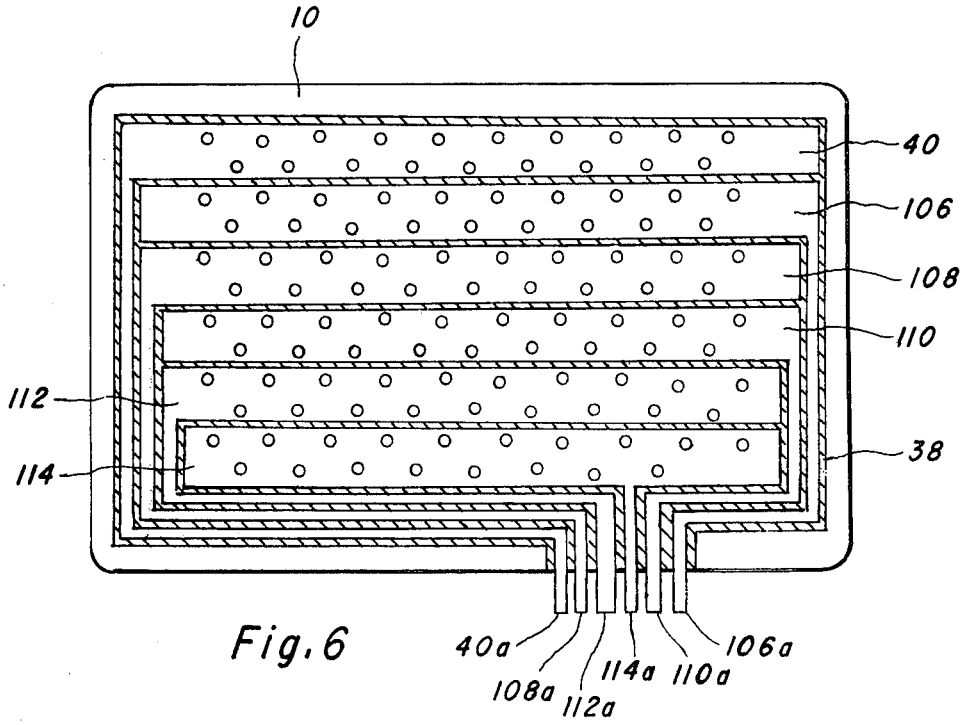
FIG. 6 is a front view of a completed subassembly showing a switching plate fabricated according to the process of the invention.

A front view of a completed subassembly is indicated in FIG. 6. As indicated, the subassembly has a matrix of apertures 32 defined therein. These apertures are arranged so as to constitute isolated separate conductive portions 40, 106, 108, 110, 112, and 114. These conductive portions are isolated from each other by means of the isolation grooves provided for during the manufacture of the subassembly. One such isolation groove 38 is indicated in FIG. 6. These isolation grooves may define a preselected pattern of apertures for selective activation as desired. Any number of holes may be grouped in any desired pattern. For example, columns or rows may be provided for any geometric pattern that would have utility for the desired electron beam scanning stack.

Each isolated conductive portion must be provided with a contact means. These conductive contact leads are fabricated into the metal plates containing the isolated separate conductive portion by the same fabrication method and during the same sequence of events that defines the separate conductive portions therein. In this regard, the contact leads from the separate conductive portions are isolation etched into the inactive peripheral area of the control plate. These contact leads extend along the periphery of the plates where they terminate in the form of multiple contact tabs protruding from the edge of the plate. These contact tabs are represented by FIGS. 40*a*, 108*a*, 106*a*, 110*a*, 112*a*, and 114*a*. These contact tabs may now be used for providing the necessary leads to connect the individually isolated conductive portions with the electronic circuitry of the electron beam scanning stack. These leads may be fabricated long enough in one embodiment to actually protrude through the external wall of the flat tube display case and therefore provide a convenient contact means. In another embodiment, the contact tabs remain within the flat tube display case so as to be internal contact means. These contact tabs and contact leads may be arranged in other patterns not indicated in FIG. 6.

As indicated above, subassemblies may comprise any number of metal plates bonded together by means of dielectric material. These subassemblies are bonded together by vitreous glass-frit without the use of metal plates or with the use of metal plates that have been coated with vitreous glass-frit and have a corresponding matrix of apertures therein. These subassemblies are arranged to provide a switching stack array using a thermal vitreous glass-frit firing cycle and aperture alignment fixtures to produce a completed electron beam scanning stack having a matrix of electron beam channels therein.

It is clear to one skilled in the art that any number of subassemblies may be assembled together to fabricate the completed electron beam scanning stack. In addition, each subassembly may be fabricated so as to have any desired function such as switching or modulating. There is no limit to the complexity of the subassemblies or to the functions that may be achieved with them. In addition, the combination of the subassemblies in terms of number and function may be infinite, only limited by the expertise of the user.

The electron beam scanning stack fabricated according to the method of the present invention has a variety of advantages over prior art methods. For example, no glass parts are to be fabricated or utilized which would constitute a source of breakage. Hole etching and lead etching processes are separate; this inherently allows for better control of the hole size independent of line separation. The electrical conductive portions of the stack are made from thicker materials rather than evaporated thin films which correspondingly results in lower lead resistance in addition to more rugged leads, making it easier to burn out those shorts that may be present. This method also eliminates the need for extremely hazardous chemical processes that are required for the etching of glass plates. Thinner stacks having substantially improved electron transmission can be fabricated which results in much brighter display pictures. The need for precious metals in the fabrication of stacks is eliminated therefore reducing processing costs.

Stacks fabricated by the method of this invention can be operated at much higher current input to the input buffer without danger of stack breakage. With the use of heavy leads or tabs etched as part of the input buffer, thermal stresses can be greatly reduced.

In addition, electrical leads are etched as part of the plate fabrication process. These leads can be used directly as part of a connector assembly, thus eliminating completely the wire bonding process to the switching stack. This is important because a typical electron beam scanning stack can have several hundred stack leads which require two wire bonds in each of the conventional stacks.

Figure 7:
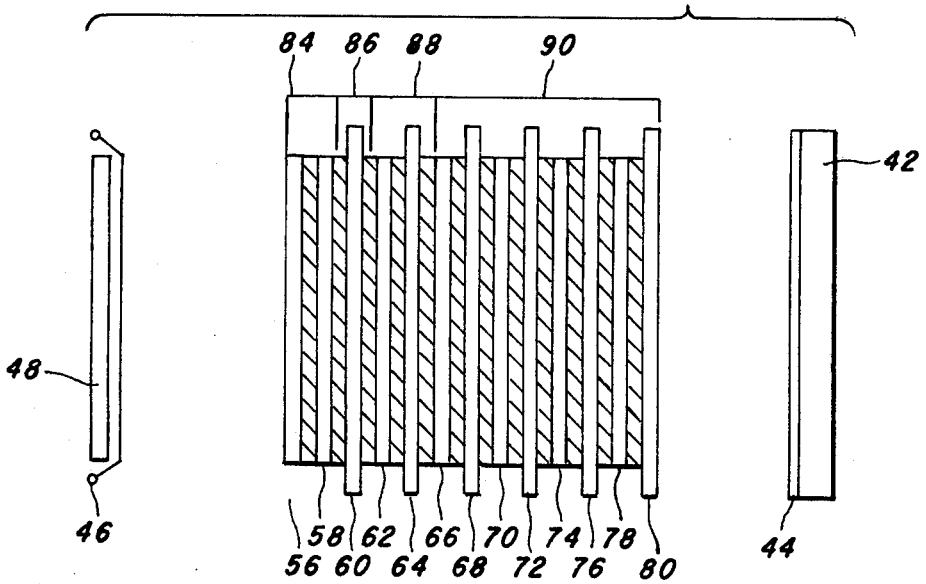
FIGS. 7 and 8 are sectional views of an electron beam scanning device fabricated according to the process of the present invention.

FIG. 7 indicates a completed electron beam scanning stack fabricated according to the method of the present invention. A viewing screen 42 is provided with a phosphor surface 44 as a target area. An electron source 46 is provided with a field shaping plate 48 therebehind. In between the electron source and the phosphor screen is inserted a plurality of metal plates comprising an electron beam scanning stack fabricated according to the method of the present invention.

Glass-frit is represented by the hatched areas. Section 84 represents a two-plate subassembly comprising plates 56 and 58, which respectively represent a horizontally segmented input buffer and a multi-segmented horizontal switching plate of double rows fabricated according to the method of the present invention. Section 88 represents a second subassembly comprising also of two plates 62 and 64, which represent respectively a multi-segmented vertical modulating plate and another multi-segmented horizontal switching plate of single rows. The two subassemblies are bonded together by means of a glass-frit coated metal plate 60 represented as section 86.

A focusing subassembly is represented by section 90 comprising plates, 66, 68, 70, 72, 74, 76, 78, and 80. These plates are alternating buffer plates and metal plates. Focusing assembly acts to focus the switchecd electrons to respective target areas on the phosphor coating 44. The switching subassemblies are bonded to the focusing subassembly by glass-frit. It is relatively apparent to one skilled in the art that the subassemblies may comprise two-plate subassemblies or multi-plate subassemblies, each subassembly having any desired function, and any number of subassemblies may be bonded together to form an electron beam scanning stack. The electron beam scanning stack represented by FIG. 7 is only one possible embodiment using the method of the present invention.

Figure 8:
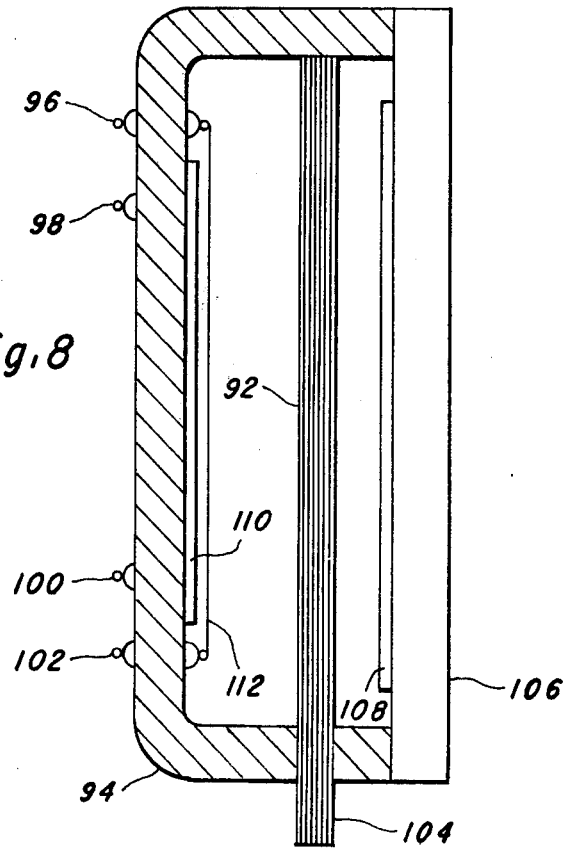

FIG. 8 indicates a completed electron beam scanning system such as a flat tube display. A viewing screen 106 is provided with a phosphor target 108. An electron beam source 112 has two external electrodes 96 and 102. Electrons are directed towards the switching stack 92 by means of plate 110 having electrodes 98 annd 100. The electron beam switching stack 92 has a plurality of contact leads 104 extending through the flat tube displays case 94. This FIG. 12 of a flat tube display is highly simplified and is only intended to indicate the utility for the electron beam scanning stack fabricated by the method of the present invention. An electron beam scanning stack fabricated by the method of the present invention may be employed in other more complicated systems that require the need for switching and modulating electrons in a preselected manner in addition to other operating functions.

Other applications for the methods of the present invention include metal laminated structures to be used in place of conventional copper-plastic multilayer printed circuit boards. It could also be used in other types of matrix address displays such as a two- or three-dimensional switching array. In each case the construction would be similar to the present design. For better conduction, copper would be used for multi-layer circuit boards. Correspondingly, for lower operating voltages a metal with a lower work function would be used for plasma displays.

While particular embodiments of this invention have been disclosed herein, it will be understood that various modifications may become apparent to those skilled in the art without departing from the spirt and scope of the invention which is defined by the appended claims.

I claim:

1. A method of fabricating an electron beam scanning stack comprising the steps of:

fabricating a matrix of apertures in a first and second plurality of metal plates having first and second planar surfaces;

fabricating a groove pattern in said first planar surface of at least two of said first plurality;

coating said first surface having said groove pattern with dielectric material;

aligning said apertures of said first plurality having said groove pattern to form a matrix of electron channels therein;

bonding said plates having said groove pattern together by means of said dielectric material;

fabricating said groove pattern into an isolation channel from said second planar surface of said first plurality, thereby fabricating a subassembly;

coating said first planar surface of at least one of said second plurality with dielectric material;

aligning said apertures of at least two of said second plurality forming a matrix of electron channels therein, at least one of said second plurality having said dielectric coating thereon;

bonding said second aligned plurality together by means of said dielectric material to form a matrix of electron channels therein;

aligning said electron channels of said subassembly with said electron channels of said bonded second plurality; and bonding said bonded second plurality to said second planar surface of said subassembly by means of a layer of dielectric material.

2. A method as set forth in claim 1 further including the steps of:

fabricating a plurality of said subassemblies;

coating said second planar surface of said subassembly with dielectric material;

aligning the electron channels in said plurality of said subassemblies; and bonding said plurality of said subassemblies together by means of said dielectric material.

3. A method as set forth in claim 2 further including the step of bonding together said plurality of subassemblies by means of a dielectric coated plate of said second plurality having aligned apertures therewith.

4. A method of fabricating an electron beam scanning stack comprising the steps of:

fabricating a matrix of apertures in a first and second plurality of metal plates having first and second planar surfaces;

coating said first surface of at least one of said first plurality with dielectric material;

aligning said apertures of said first plurality containing at least one of said coated plates to form a matrix of electron channels therein;

bonding said first plurality together by means of said dielectric material on said at least one coated plate;

fabricating into isolation channels said bonded first plurality from said second planar surface of said first plurality, thereby fabricating a subassembly;

coating said first planar surface of at least one of said second plurality with dielectric material;

aligning said apertures of at least two of said second plurality forming a matrix of electron channels therein, at least one of said second plurality having said dielectric coating thereon;

bonding said second aligned plurality together by means of said dielectric material to form a matrix of electron channels therein;

aligning said electron channels of said subassembly with said electron channels of said bonded second plurality; and bonding said bonded second plurality to said second planar surface of said subassembly by means of a layer of dielectric material.

5. A method as set forth in claim 4 further including the steps of;

fabricating a plurality of said subassemblies;

coating said second planar surface of said subassembly with dielectric material;

aligning said electron channels in said plurality of subassemblies; and bonding said plurality of subassemblies together by means of said dielectric material.

6. A method as set forth in claim 5 further including the step of bonding together said plurality of subassemblies by means of a dielectric coated plate of said second plurality having aligned apertures therewith.

7. A method as set forth in claim 6 further including the step of fabricating isolated contact leads in said first plurality.

* * * * *